US008033217B2

(12) United States Patent
Ashikagaya et al.

(10) Patent No.: US 8,033,217 B2
(45) Date of Patent: Oct. 11, 2011

(54) STENCIL PRINTING APPARATUS

(75) Inventors: Atsushi Ashikagaya, Miyagi (JP); Mituru Takahashi, Miyagi (JP); Masaru Ohdaira, Miyagi (JP); Yoshihito Ebina, Miyagi (JP)

(73) Assignee: Tohoku Ricoh Co., Ltd, Shibata-gun (JP)

( * ) Notice: Subject to any disclaimer, the term of this patent is extended or adjusted under 35 U.S.C. 154(b) by 517 days.

(21) Appl. No.: 12/141,403

(22) Filed: Jun. 18, 2008

(65) Prior Publication Data

US 2009/0126585 A1 May 21, 2009

(30) Foreign Application Priority Data

Nov. 21, 2007 (JP) ..... 2007-301915

(51) Int. Cl.
*B41L 13/04* (2006.01)

(52) U.S. Cl. ..... 101/116; 101/128.4

(58) Field of Classification Search ..... 101/114, 101/116, 128.4, 129, 477
See application file for complete search history.

(56) References Cited

U.S. PATENT DOCUMENTS 5,623,871 A * 4/1997 Takahira ..... 101/114
6,782,812 B2 * 8/2004 Hasegawa et al. ..... 101/128.4

FOREIGN PATENT DOCUMENTS

| | | |
|---|---|---|
| JP | 62-30117 | 6/1987 |
| JP | 2001-213039 | 8/2001 |
| JP | 2005-153477 | 6/2005 |
| JP | 2007-55073 | 3/2007 |

* cited by examiner

*Primary Examiner* — Ren Yan
(74) *Attorney, Agent, or Firm* — Oblon, Spivak, McClelland, Maier & Neustadt, L.L.P.

(57) ABSTRACT

A stencil printing apparatus for wrapping a master around an outer circumferential surface of a plate cylinder to perform printing, the stencil printing apparatus being capable of preventing the occurrence of abnormal images or afterimage phenomenon which causes confidential information leakage, without increasing cost or causing any problems. This stencil printing apparatus has time measuring means for measuring a leaving time during which the apparatus is left stand, and when a plate discharge command is output before the leaving time exceeds a first predetermined time while the master is wrapped around the outer circumferential surface, the stencil printing apparatus is shifted to a standby state after the master is discharged from the outer circumferential surface.

13 Claims, 13 Drawing Sheets

STENCIL PRINTING APPARATUS

BACKGROUND OF THE INVENTION

1. Field of the Invention

The present invention relates to a stencil printing apparatus which wraps a master around a plate cylinder to perform printing, and more specifically to a technology for preventing the occurrence of abnormal images and the occurrence of confidential information leakage associated with the afterimage phenomenon caused by degenerated ink.

2. Description of the Related Art

As a simple printing method, digital heat-sensitive stencil printing has been conventionally known. This allows a thermal head having a plurality of heat generators to come into contact with a master obtained by sticking a thermoplastic resin film and a porous support together, conveys the master using conveying means such as a platen roller while pulsely energizing the heat generating elements, to thereby heat-melt punch a perforated image on the thermoplastic resin film of the master on the basis of image information. Thereafter, the perforated master is wrapped around a porous circular plate cylinder, and a sheet is pressed against the outer circumferential surface of the plate cylinder by means of a press roller or other pressing means to thereby cause ink that is supplied to the inner circumferential surface of the plate cylinder to bleed from the perforation part of a plate cylinder and the perforated part of the master, and to transfer the ink to the sheet to obtain a printed image on the sheet.

In the stencil printing apparatus used in the above-described stencil printing, generally the standby state is held while the master of a preceding plate is wrapped around the plate cylinder, during the period between the time when the printing is ended and the time when the next plate-making operation instruction is issued. The reason is to prevent the occurrence of the following problems when the plate cylinder is left stand for a long time after the master is released: (1) foreign matters might adhere to the exposed outer circumferential surface of the plate cylinder, causing an image failure; (2) the surface layer of the ink might be exposed to the air, changing the ink composition and deteriorating the image quality; and (3) the user of the stencil printing apparatus might mess his/her hands and cloth when detaching the drum from the apparatus main body.

However, letting the apparatus stand for a predetermined amount of time or more while the printed master is wrapped therearound causes a change in ink composition between the perforated section and non-perforated section of the wrapped master. The main example of the ink used in stencil printing is an emulsion ink in which water is dispersed in oil. A change in the composition of this ink hardly occurs between the perforated section and non-perforated section of the wrapped master because, when this ink adheres to the master, the ink remaining on the non-perforated section of the master is protected by the master so that it is not exposed to the air, while the ink remaining on the perforated section of the master is easily exposed to the air and thereby the aqueous phase component of the ink composition evaporates significantly, reducing the ink viscosity and making the ink watery. The difference in the change in ink composition becomes notable as the time for letting the apparatus stand passes, and when the time for letting the apparatus stand exceeds a predetermined time period, the ink of the changed composition creates an afterimage (particularly on the part with a photographic image) when the next plate-making and printing operation are performed, whereby image failures might occur on the first tens of images and some information might leak due to the fact that the contents of the previous original can be inferred from the afterimage.

When, on the other hand, the apparatus is left stand for a relatively short time and the predetermined period is not exceeded, it is understood that letting the apparatus stand while the printed master is wrapped therearound does not affect the next plate-making and printing, but a method for performing detailed control of the presence or absence of a master around the plate cylinder in accordance with the elapsed time has not yet been proposed for the mechanism for generating the afterimage phenomenon.

For these drawbacks described above, Japanese Examined Patent Publication No. S62-30117 (Prior Art 1), for example, discloses a technology in which a security protection mode is provided to prevent the confidential information from leaking a master used in printing, wherein the master of a preceding plate is discharged during the security protection mode to wrap an unprocessed master around a plate cylinder. Also, Japanese Unexamined Patent Publication No. 2001-213039 (Prior Art 2) discloses a technology for preventing the clogging with ink that is caused by leaving a plate cylinder having a master of a preceding plate wrapped therearound for a long time, wherein in the case where the final printing operation is not the confidential plate-making operation, the master on the plate cylinder is discharged after a predetermined time period has elapsed since the final printing operation and an unprocessed master is wrapped around the plate cylinder. Moreover, Japanese Unexamined Patent Publication No. 2005-153477 (Prior Art 3), for example, discloses a technology for securely preventing a third party from reproducing an image using a used master when the security protection mode is set, wherein when the security protection mode is set a master is discharged from a plate cylinder upon completion of a printing operation and a state where the plate cylinder has no master is maintained. Japanese Unexamined Patent Publication No. 2007-55073 (Prior Art 4), for example, discloses a technology for preventing a master from adhering to a plate cylinder due to ink solidification, wherein when a user does not request for plate discharge upon completion of a printing operation a plate-discharging operation is performed automatically.

In the technologies disclosed in Prior Art 1 and Prior Art 2 above, although the effects of these technologies are acknowledged, the problem in these technologies is that a new unprocessed master is required and two masters are actually necessary for printing because an extra plate of master is spent in each printing.

In the technology disclosed in Prior Art 3 above, the plate-discharging operation is performed immediately when the security protection mode for protecting confidential information is set; which prevents an operator from performing additional printing of his/her original and, due to the exposed outer circumferential surface of the plate cylinder even for a short time in which the afterimage phenomenon does not usually occur, foreign matters adhere to the outer circumferential surface of the plate cylinder and cause an image failure, or the surface layer of the ink is exposed to the air, changing the ink composition and deteriorating the image quality. Moreover, a hand or cloth of the operator might be contaminated when detaching the plate cylinder from the apparatus main body.

The technology disclosed in Prior Art 4 above is designed for preventing a master from sticking to the outer circumferential surface of the plate cylinder, so that the plate-discharging operation can be securely performed even when the operator forgets to instruct the apparatus to perform the plate-discharging operation, and so that the operator can secure an extra time for performing printing again by providing a time difference until the plate-discharging operation is performed. However, a master will not be wrapped around the outer circumferential surface of the plate cylinder unless the operator issues a plate-making instruction after performing printing, hence the same problems as the abovementioned "Prior Art 3" occur.

Although a certain effect of each of the conventional technologies is acknowledged in not only the cases that are not aimed at reducing the occurrence of the afterimage phenomena but also the cases aimed at reducing the occurrence of the afterimage phenomena, each conventional technology has the elements that cause the problems, such as the increase in cost of spending masters, cost increase caused by adding new members, decrease in efficiency of an additional printing job, which is caused by frequent plate-discharging operations, and image failure and contamination caused by exposing the plate cylinder.

SUMMARY OF THE INVENTION

The present invention was contrived in view of the problems of the conventional technologies described above, and an object of the present invention is to provide a stencil printing apparatus that is capable of preventing the occurrence of abnormal images or afterimage phenomenon which causes confidential information leakage, without increasing cost or causing any problems.

In an aspect of the present invention, a stencil printing apparatus wraps a master around an outer circumferential surface of a plate cylinder to perform printing and comprises a time measuring device for measuring a leaving time during which the apparatus is left stand. When a plate discharge command is output before the leaving time exceeds a first predetermined time while the master is wrapped around the outer circumferential surface, the stencil printing apparatus is shifted to a standby state after the master is discharged from the outer circumferential surface.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

The stencil printing apparatus according to an embodiment of the present invention will now be described hereinafter in detail with reference to the drawings.

Figure 1:
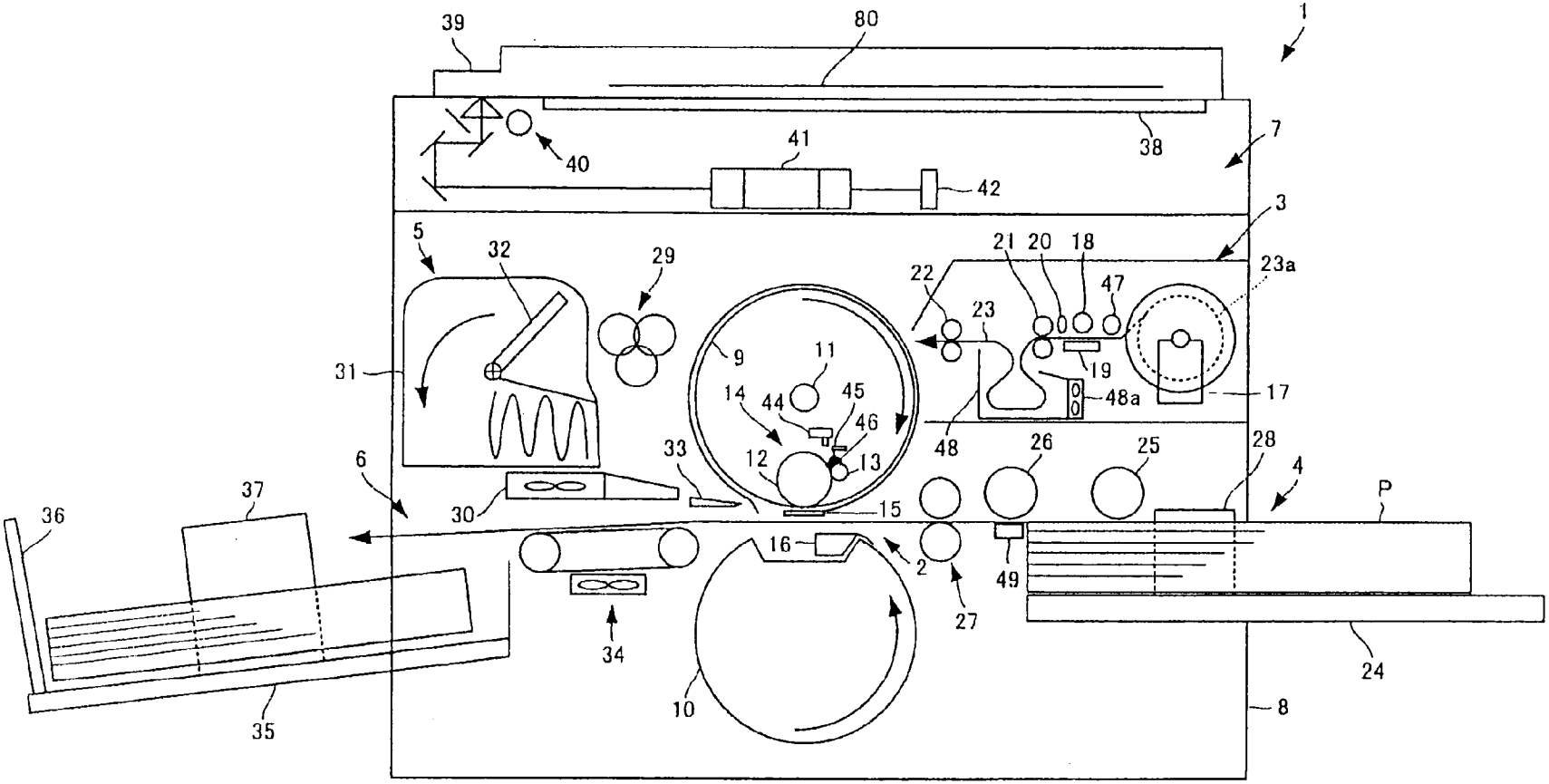
FIG. 1 is a front view showing a schematic configuration of a stencil printing apparatus in which an embodiment of the present invention is adopted.

FIG. 1 shows a stencil printing apparatus in which the present embodiment is adopted. In the drawing the stencil printing apparatus 1 has a printing portion 2, plate-making portion 3, sheet-feeding portion 4, plate-discharging portion 5, sheet-discharging portion 6, image reader 7, and the like.

The printing portion 2, provided in substantially the center of an apparatus main body 8, has a plate cylinder 9, an impression cylinder 10, and the like. The plate cylinder 9 is rotatably supported by a shaft 11, rotated and driven by plate cylinder driving means, which is not shown, and configured to be detachable from the apparatus main body 8. On the inside of the plate cylinder 9, there is provided ink supply means 14 having an ink roller 12, doctor roller 13, ink distributor 44, ink amount detection sensor 45 and the like. An ink pool 46 is formed between the ink roller 12 and the doctor roller 13. The outer circumferential surface of the plate cylinder 9 is provided with an opening portion with a plurality of perforated holes for bleeding an ink supplied by the ink supply means 14, and a non-opening portion. A damper 15 for holding a leading end of a master is mounted openably and closably on the non-opening portion. As shown in FIG. 1, when the plate cylinder 9 is rotated and driven by the plate cylinder driving means (not shown), the ink roller 12 and doctor roller 13 are rotated in synchronization and thereby the ink is supplied to the inner circumferential surface of the plate cylinder 9.

The impression cylinder 10, which has a diameter same as that of the plate cylinder 9 and is rotated and driven by driving means, not shown, is provided below the plate cylinder 9. The impression cylinder 10 has a cutout on the outer circumferential surface thereof, and this cutout is provided with a gripper 16 openably and closably so as to hold a sheet P on the outer circumferential surface of the impression cylinder 10. The impression cylinder 10 is oscillated by oscillating means, which is not shown, and the outer circumferential surface of the impression cylinder 10, excluding the cutout, is configured so as to freely contact with and separate from the outer circumferential surface of the plate cylinder 9. Note that, in place of the impression cylinder 10, it is possible to use a press roller, which has a smaller diameter than the impression cylinder 10, is configured so as to freely contact with and separate from the outer circumferential surface of the plate cylinder 9, and is driven to rotate in pressure contact with the plate cylinder 9.

The plate-making portion 3 is provided in the upper right in the apparatus main body 8. The plate-making portion 3 has a master holding member 17, master press roller 47, platen roller 18, thermal head 19, master cutting means 20, pairs of master conveying rollers 21, 22, master stock means 48, and the like. The master holding member 17 is attached to a side plate of the apparatus main body 8, which is not shown, and supports, rotatably and detachably, the core of a master roll 23*a* around which a master 23 is wound in the form of a roll, the master 23 being obtained by sticking a thermoplastic resin film and a porous support together.

The master press roller 47 provided to the left of the master holding member 17 pulls the master 23 out of the master roll 23*a*. The platen roller 18 is rotatably supported by the side plate of the apparatus main body 8, which is not shown, and is rotated and driven by a stepping motor which is not shown. The thermal head 19, which has a plurality of heat generating elements, is positioned below the platen roller 18 and attached to the unshown side plate of the apparatus main body 8. The surface with the heat generating elements is brought into pressure contact with the circumferential surface of the platen roller 18 by the energizing force of energizing means, which is not shown. The thermal head 19 selectively causes the heat generating element to generate heat, while contacting with the surface of the thermoplastic resin film of the master 23, to perform heat-melt punching on the master 23.

The master cutting means 20 is provided to the left of the platen roller 18 and thermal head 19. The master cutting means 20 has a movable blade supported movably on a frame of the apparatus main body 8, which is not shown, and cuts the master 23 by rotating and moving the movable blade.

The pairs of master conveying rollers 21, 22 are provided to the left of the master cutting means 20. Each of the pairs of master conveying rollers 21, 22 has a driving roller and a driven roller, which are rotatably supported by the unshown side plate of the apparatus main body 8, where the driving roller is rotated and driven unshown driving means in synchronization with the platen roller 18, while the driven roller is brought into pressure contact with the corresponding driving roller by the unshown energizing means.

The master stock means 48 is provided between and below the pairs of master conveying rollers 21, 22. The boxy master stock means 48 is configured so as to be capable of containing one plate of processed master 23 therein, and a fan 48*a* for drawing in the master 23 is disposed in a lower part of the master stock means 48.

The sheet-feeding portion 4 is provided below the plate-making portion 3. The sheet-feeding portion 4 has a sheet-feeding tray 24, sheet-feeding roller 25, separation roller 26, separation pad 49, resist roller pair 27, and the like. The sheet-feeding tray 24 capable of staking a plurality of sheets P thereon is supported by the apparatus main body 8 so as to be able to move up and down freely, and is moved up and down by lifting means, which is not shown. A pair of side fences 28 is provided on the upper surface of the sheet-feeding tray 24 so as to be movable in synchronization in a sheet width direction perpendicular to a sheet conveyance direction.

The sheet-feeding roller 25, having a high friction resistance member on its surface, is provided at the upper left end of the sheet-feeding tray 24. The sheet-feeding roller 25 is rotatably supported by a bracket, which is not shown but supported by the apparatus main body 8 so as to be able to oscillate. When the sheet-feeding tray 24 is lifted up by the unshown lifting means, the sheet-feeding roller 25 is brought into pressure contact with the top sheet P on the sheet-feeding tray 24 at a predetermined pressure contact force. The sheet-feeding roller 25 is then rotated and driven by an unshown sheet-feeding motor constituted by the stepping motor.

The separation roller 26 and separation pad 49 are provided to the left of the sheet-feeding roller 25. The separation roller 26 has a high friction resistance member on its surface and is rotated and driven by the unshown sheet-feeding motor in the same direction as and in synchronization with the rotation of the sheet-feeding roller 25. The separation pad is brought into pressure contact with the separation roller 26 at a predetermined pressure contact force by the energizing force of the unshown energizing means.

The resist roller pair 27 having a driving roller and driven roller is provided to the left of the separation roller 26. The driving roller is supported rotatably between unshown side plates of the apparatus main body 8 and rotated and driven by the unshown stepping motor. The driven roller is supported rotatably between the unshown side plates of the apparatus main body 8 and brought into pressure contact with the driving roller at a predetermined pressure contact force by the energizing force of the unshown energizing means.

The plate-discharging portion 5 is provided at the upper left of the printing portion 2. The plate-discharging portion 5 has a plate-discharging roller 29, plate-discharging box 31, compression board 32, and the like. The plate-discharging roller 29 is configured by rollers supported by three shafts, and rotated driven by plate-discharge driving means, which is not shown. One of the rollers is configured so as to be moved freely by moving means, not shown, and selectively takes its default position shown in the drawing and a release position where the outer circumferential surface of this roller comes into abutment against the outer circumferential surface of the plate cylinder 9.

The plate-discharging box 31 for containing the used master therein is configured to be detachable from the apparatus main body 8. The compression board 32, which pushes the used master carried by the plate-discharging roller 29 into the plate-discharging box 31, is supported rotatably by the apparatus main body 8 and turned by the unshown driving means.

The sheet-discharging portion 6 is provided below the plate-discharging portion 5. The sheet-discharging portion 6 has a release pawl 33, release fan 30, sheet conveying means 34, catch tray 35, and the like. The release pawl 33 is supported at its base end by the apparatus main body 8 so as to be able to oscillate freely, and, by being oscillated by pawl oscillating means, which is not shown, selectively takes a proximate position where a free end of the release pawl 33 that has an acute angle comes close to the outer circumferential surface of the plate cylinder 9 and a separating position where the free end separates from the outer circumferential surface of the plate cylinder 9 in order to avoid the damper 15 or other obstacle. The release fan 30 sends air to the vicinity of the free end of the release pawl 33 to assist the release pawl 33 in releasing the sheet P from the outer circumferential surface of the plate cylinder 9.

The sheet conveying means 34 provided at the lower left of the release pawl 33 has a driving roller, driven roller, endless belt, suction fan, and the like. When the driving roller is rotated and driven by sheet-discharge driving means, which is not shown, the suction fan is activated, whereby the sheet P is suctioned onto the endless belt and conveyed to the left.

The catch tray 35 is provided to the left of the sheet conveying means 34. The catch tray 35 for stacking thereon a plurality of printed sheets P conveyed by the sheet conveying means 34 has an end fence 36 and a pair of side fences 37 in order to jog the sheets P stacked on the catch tray 35.

An image reader 7 is provided in an upper part of the apparatus main body 8. The image reader 7 has a contact glass 38 for placing an original thereon, a pressure board 39 capable of freely contacting with and separating from the contact glass 38, a scanning unit 40 for scanning and reading an original image, a lens 41 for focusing the scanned image, an image sensor 42 such as a CCD for processing the focused image, and the like. Note that the present embodiment discloses the configuration provided with the image reader 7, but the present embodiment may be adopt a configuration without the original image reader 7 in which a controller serving as a PC online output-only machine or the like is incorporated therein.

Figure 2:
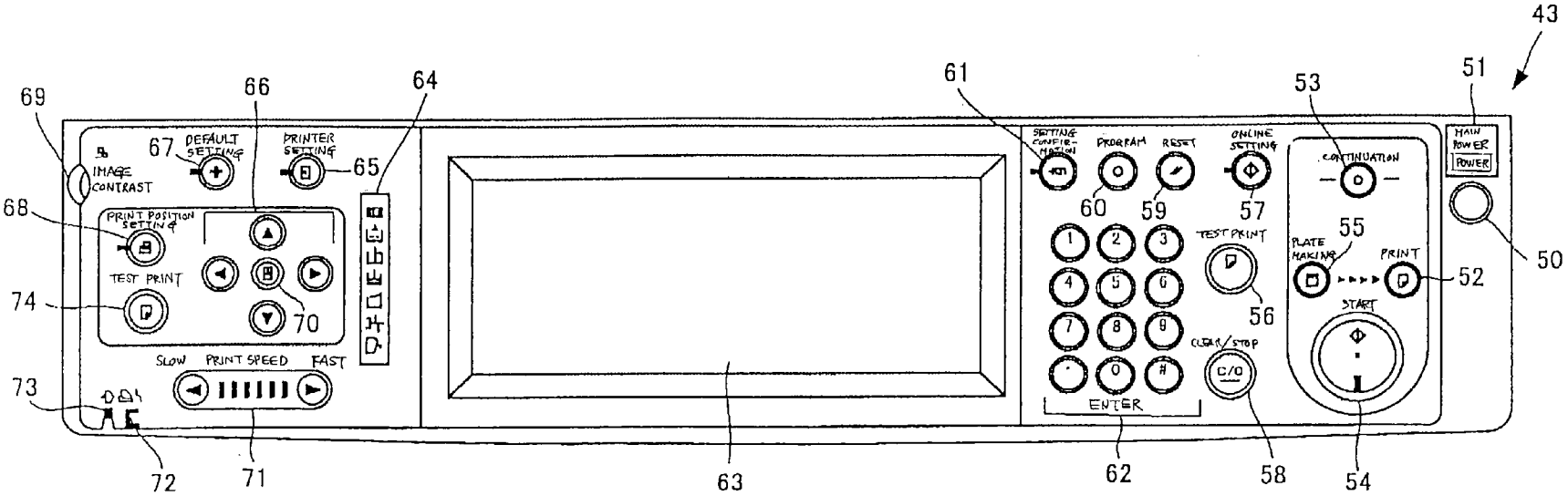
FIG. 2 is a diagram showing a schematic configuration of an operation panel used in the stencil printing apparatus.

FIG. 2 shows an operation panel of the stencil printing apparatus 1. The operation panel 43, which is provided on the front surface in the upper part of the apparatus main body 8 as shown in the drawing, has, on its upper surface, a power key 50, main power lamp 51, print mode select key 52, continuous key 53, start key 54, plate-making mode select key 55, test print key 56, online plate-making key 57, clear/stop key 58, reset key 59, program key 60, set confirmation key 61, numeric keypad 62, liquid crystal touch panel 63, display portion 64, printer setting key 65, print position setting key 66, default setting key 67, print position adjusting key 68, image contrast adjusting knob 69, print position reset key 70, print speed key 71, error lamp 72, data-in lamp 73, test print key 74, and the like.

Figure 3:
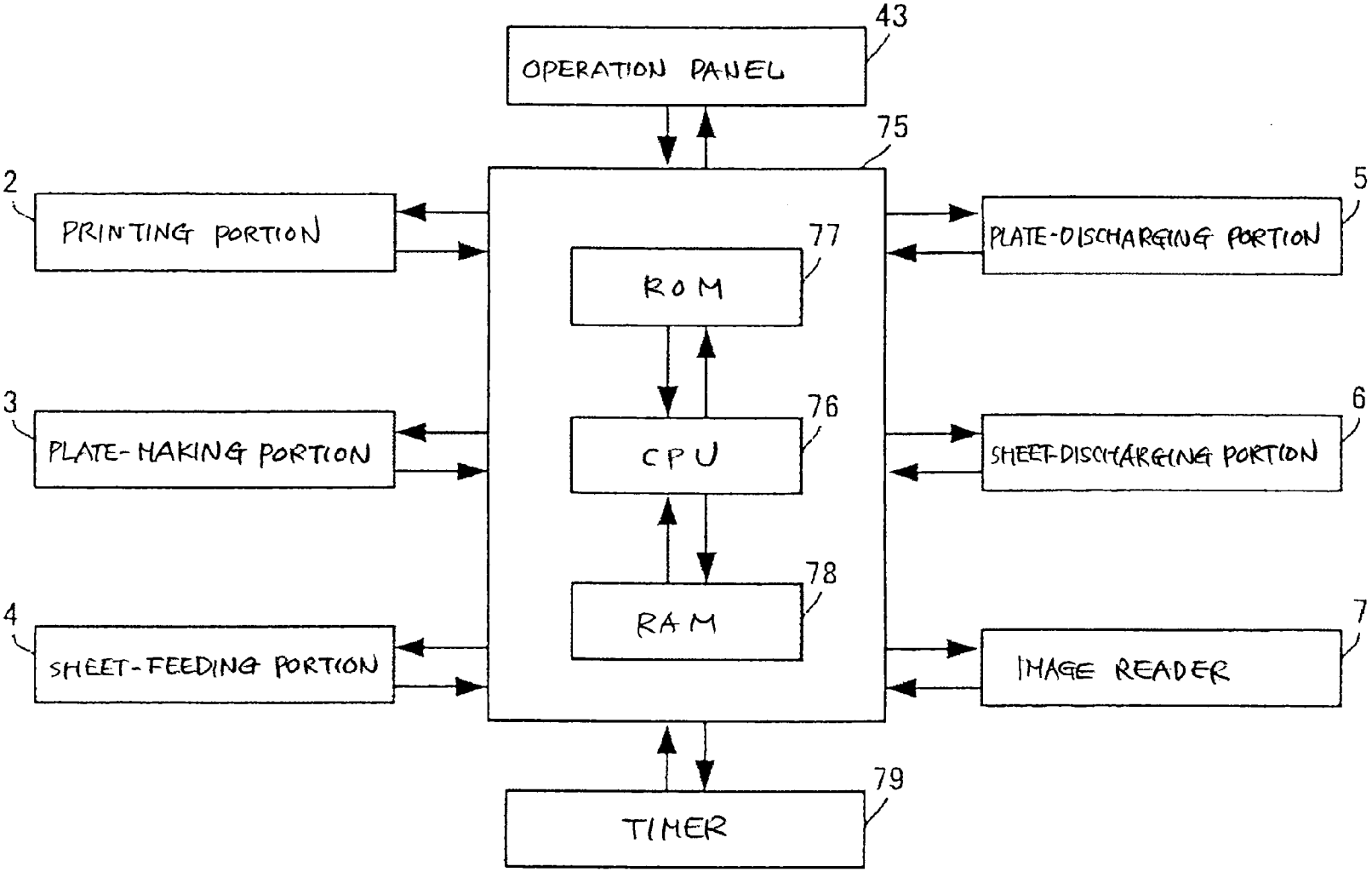
FIG. 3 is a block diagram showing the configuration of control means used in the stencil printing.

FIG. 3 shows the configuration of control means used in the stencil printing apparatus 1. In this drawing, control means 75 is a known microcomputer having a CPU 76, ROM 77 and RAM 78 therein and is provided on the inside of the apparatus main body 8. The CPU 76 operates and controls the driving means provided in the printing portion 2, plate-making portion 3, sheet-feeding portion 4, plate-discharging portion 5, sheet-discharging portion 6 and image reader 7, respectively, on the basis of various signals from the operation panel 43, detection signals from various sensors provided in the apparatus main body 8, and operation programs called out from the ROM 77. Accordingly, the CPU 76 controls the operations of the entire stencil printing apparatus 1. The ROM 77 stores therein the operation programs of the entire stencil printing apparatus 1, and these operation programs are called out appropriately by the CPU 76. The RAM 78 has a function to temporarily store computation results obtained by the CPU 76, and a function to store, as needed, data signals and on/off signals that are set and input by the various keys and various sensors on the operation panel 43. A timer 79 serving as time measuring means is connected to the control means 75, and the amount of time during which the stencil printing apparatus 1 is left stand is timed by this timer 79.

The operations of the stencil printing apparatus 1 will now be described hereinafter on the basis of the configuration above.

After an operator places an original 80 on the contact glass 38, the pressure board 39 is closed. Then, a desired printing condition is set using the print speed key 71, numeric keypad 62 and the like; followed by the operation for pressing the start key 54, whereby a reading operation for reading the original image is performed by the image reader 7. The image reading is performed is by the known "original reading method using a reduction optical system" and is performed by scanning the original image using the scanning unit 40. The read image is focused by the lens 41 and then sent to the image sensor 42. Then, an electric signal that is photoelectrically converted is subjected to A/D conversion and then processed as a digital signal.

Concurrently with this image reading operation, the plate-discharging portion 5 performs a plate-discharging operation to release the used master from the outer circumferential surface of the plate cylinder 9. Once the start key 54 is pressed, the plate cylinder 9 starts rotating. When the plate cylinder 9 reaches a plate-discharging position its rotation stops to open the damper 15. Then, the plate-discharging roller 29 is rotated and driven and at the same time moved to the release position, whereby the used master on the plate cylinder 9 is drawn up by the plate-discharging roller 29, and the drawn-up master is contained in the plate-discharging box 31 by the rotation of the plate-discharging roller 29 and the rotation of the plate cylinder 9. Thereafter, the compression board 32 is activated to compress the used master contained in the plate-discharging box 31, and the plate cylinder 9 then rotates to stop at a predetermined plate-feeding position, whereby the damper 15 is opened and the stencil printing apparatus 1 enters a plate-feeding standby state.

When the stencil printing apparatus 1 enters the plate-feeding standby state, plate-making operation and plate-feeding operation are performed based on the digitalized original image information signal. The master 23 that is pulled out of the master roll 23*a* is set in the default position by the rotations of the master press roller 47 and platen roller 18. Once the plate-making operation is started, the heat generating elements of the thermal head 19 are selectively heated based on the digitalized original image information signal, and at the same time the plate roller 18 and pair of master conveying rollers 21 are rotated and driven to thereby send out the master 23 from the master roll 23*a* at a predetermined speed. The thermoplastic resin film surface of the sent out master 23 is perforated as the master 23 passes through the thermal head 19, whereby a processed image is formed, and then the master 23 is contained in the master stock means 48 by activating the fan 48*a*.

The processed master 23 contained in the master stock means 48 is sent toward the clamper 15 by the pair of rotated and driven master conveying rollers 22. When the control means 75 determines, in terms of the number of steps of the unshown stepping motor driving the platen roller 18, that the leading end of the master 23 is conveyed to the position where it can be held by the damper 15, the damper 15 is closed and the leading end portion of the processed master 23 is held on the outer circumferential surface of the plate cylinder 9. Thereafter, the plate cylinder 9 is rotated and driven at the circumferential speed equal to the conveyance speed of the master 23 so that the master 23 is wrapped around the plate cylinder 9. When one plate of master 23 is processed, the activated platen roller 18 and pairs of master conveying rollers 21, 22 are stopped, and the master cutting means 20 is activated to cut the master 23. The cut master 23 is pulled out of the plate-making portion 3 as the plate cylinder 9 rotates, whereby the plate-making operation and plate-feeding operation are completed when the plate cylinder 9 stops rotating at its home position.

A plate-fixing operation is performed subsequent to the plate-feeding operation. When the plate cylinder 9 stops at its home position, the sheet-feeding roller 25 and separation roller 26 rotate to pull out one piece of top sheet P from the sheet-feeding tray 24, and then this pulled sheet P is temporarily stopped, with its leading end held between the resist roller pair 27. The plate cylinder 9 is rotated and driven in the clockwise direction as shown in FIG. 1 at low speed as the sheet-feeding portion 4 is activated, and the resist roller pair 27 is rotated and driven at a predetermined timing immediately before an image region leading end portion of the master 23 wrapped around the plate cylinder 9 in the direction of rotation of the plate cylinder reaches a position where the image region leading end portion comes into contact with the impression cylinder 10. Due to the rotation of the resist roller 27, the fed sheet P is held on the outer circumferential surface of the impression cylinder 10 by the gripper 16 and then fed toward a position where it comes into contact with the plate cylinder 9 as the impression cylinder 10 rotates. Then, the unshown oscillating means is activated to bring the circumferential surface of the impression cylinder 10 into pressure contact with the outer circumferential surface of the plate cylinder 9 so that the fed sheet P is brought into pressure contact with the master 23 on the plate cylinder 9. Due to this pressing operation, the impression roller 10, sheet P, master 23 and plate cylinder 9 come into contact with one another, and the ink supplied to the inner circumferential surface of the plate cylinder 9 by the ink roller 12 is caused to bleed from the perforation part of the plate cylinder 9, accumulated in the porous support of the master 23 and transferred to the sheet P through the perforated part of the master 23. The so-called plate-fixing operation is performed in this manner.

By activating the release pawl 33 and release fan 30 after the gripper 16 is opened, the sheet P, to which an image is transferred by the plate-fixing operation, is released from the outer circumferential surface of the plate cylinder 9, suctioned and conveyed by the sheet conveying means 34 and discharged onto the catch tray 35. Thereafter, the plate cylinder 9 stops rotating at its home position and, when the continuous key 53 is not pressed, the plate-fixing operation is ended and consequently the stencil printing apparatus 1 enters a printing standby state. When the operator obtains a proper image position of the printed matter after the stencil printing apparatus 1 enters the printing standby state, the operator presses the print position setting key 66 to adjust the image position and then presses the test print keys 56, 74 to perform a test print on only one sheet P fed from the sheet-feeding portion 4. After the image position is confirmed by performing the test print, the number of prints is set by the input operation using the numeric keypad 62, the print speed is set using the print speed key 71, and then the start key 54 is pressed so that the sheets P are fed successively from the sheet-feeding portion 4 and the printing operation is performed. Once the set number of prints is used up, the plate cylinder 9 stops at its home position and thereby the stencil printing apparatus 1 enters the printing standby state again.

The operation that is performed when the abovementioned stencil printing apparatus 1 is shifted to a standby position will now be described as one of the characteristics of the present invention. In the present circumstances, not only the stencil printing apparatuses but also all image forming apparatuses are generally provided with an operation function for a power saving mode for the purpose of reducing power consumption, and the stencil printing apparatus 1 described in the present embodiment also has the same function. "Power saving mode" described herein means a function to cut electric power consumption during a standby state by turning off the display on the operation panel or switching off the main power.

Figure 4:
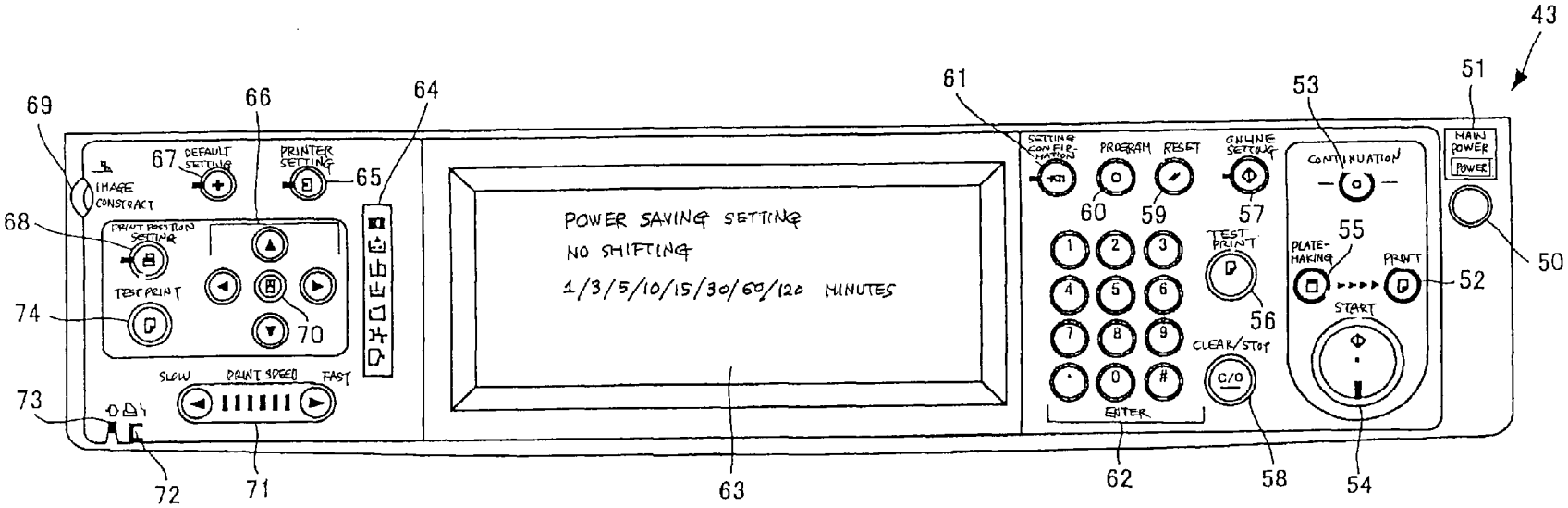
FIG. 4 is a diagram showing a schematic configuration of the operation panel to explain the power saving setting performed in the stencil printing apparatus.

When the operator presses the default setting key 67 on the operation panel 43 a predetermined number of times, the screen on the liquid crystal touch panel 63 displays "power consumption setting" as shown in FIG. 4, where "do not shift" or shifting time of "1 minute," "3 minutes," "5 minutes," "10 minutes," "15 minutes," "30 minutes," "60 minutes" or "120 minutes" can be selected. In this stencil printing apparatus 1, the timer 79 starts measuring the time upon completion of the operation for printing the set number of prints, and this time measuring operation continues until the next operation instruction is output. When the time measured by the timer 79 becomes the time set in "power consumption setting," the stencil printing apparatus 1 is shifted to the power saving mode. When "do not shift" is selected in "power consumption setting," the stencil printing apparatus 1 enters the standby position without being shifted to the power saving mode.

Figure 5:
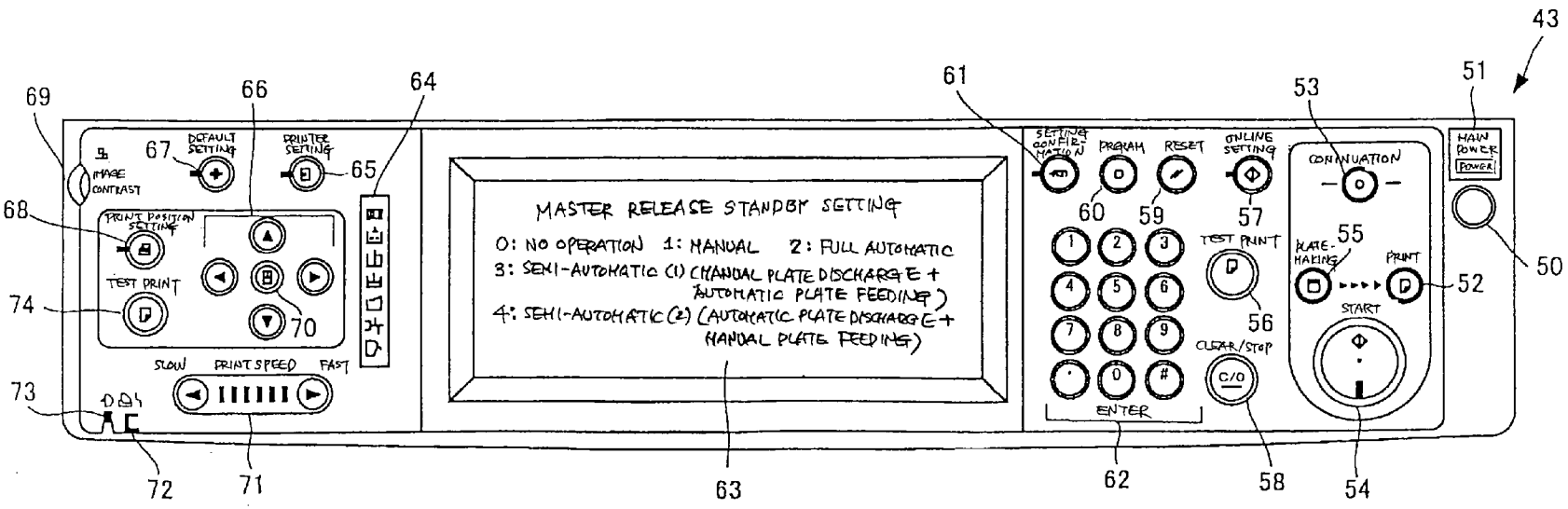
FIG. 5 is a diagram showing a schematic configuration of the operation panel to explain the master release standby setting performed in the stencil printing apparatus.

Then the operator further presses the default setting key 67 on the operation panel 43 a predetermined number of times, the screen on the liquid crystal touch panel 63 displays "master release standby setting" as shown in FIG. 5, where "no operation," "manual," "full automatic," "semi-automatic 1 (manual plate discharge+automatic plate feeding)," or "semi-automatic 2 (automatic plate discharge+manual plate feeding)" can be selected.

Figure 6:
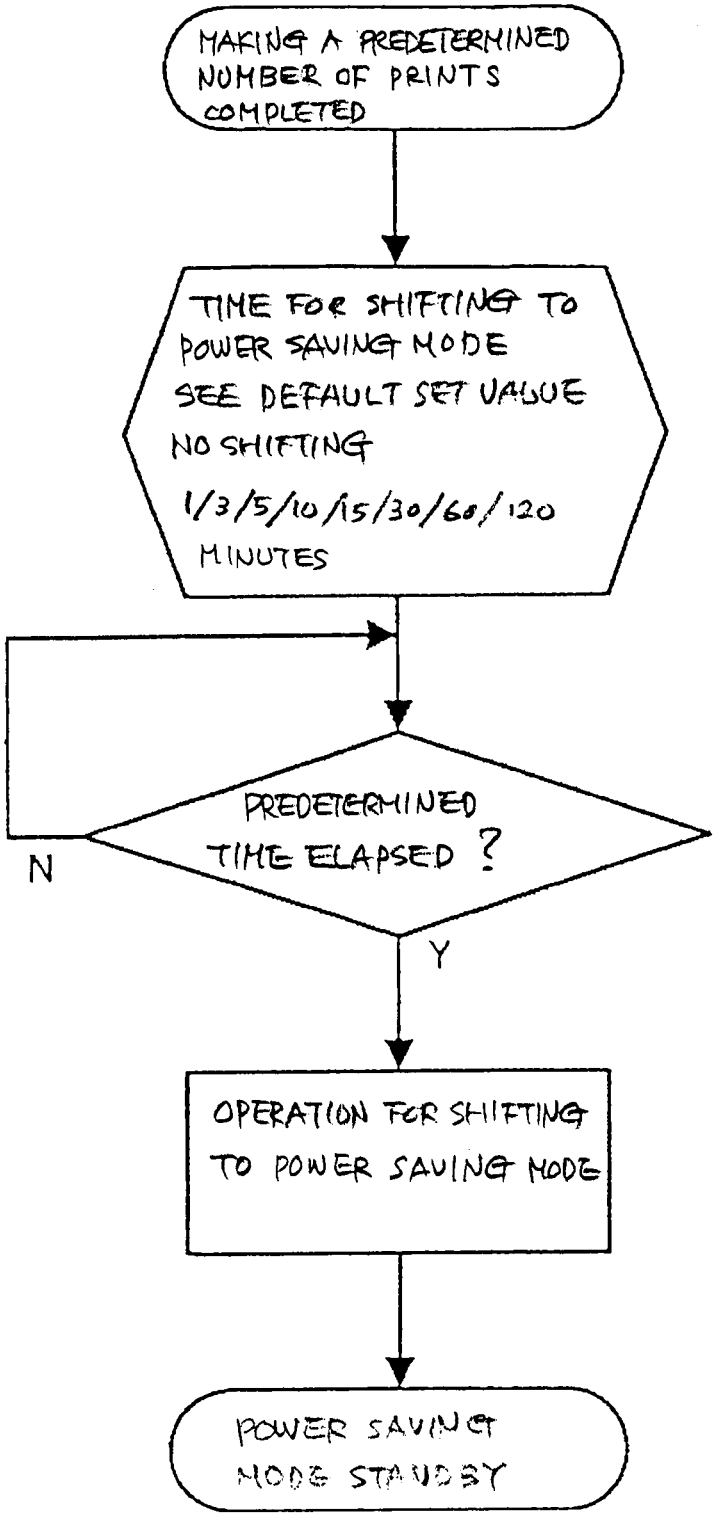
FIG. 6 is a flowchart for explaining the operations performed by the stencil printing apparatus when "no operation" is selected in the stencil printing apparatus.
Figure 7:
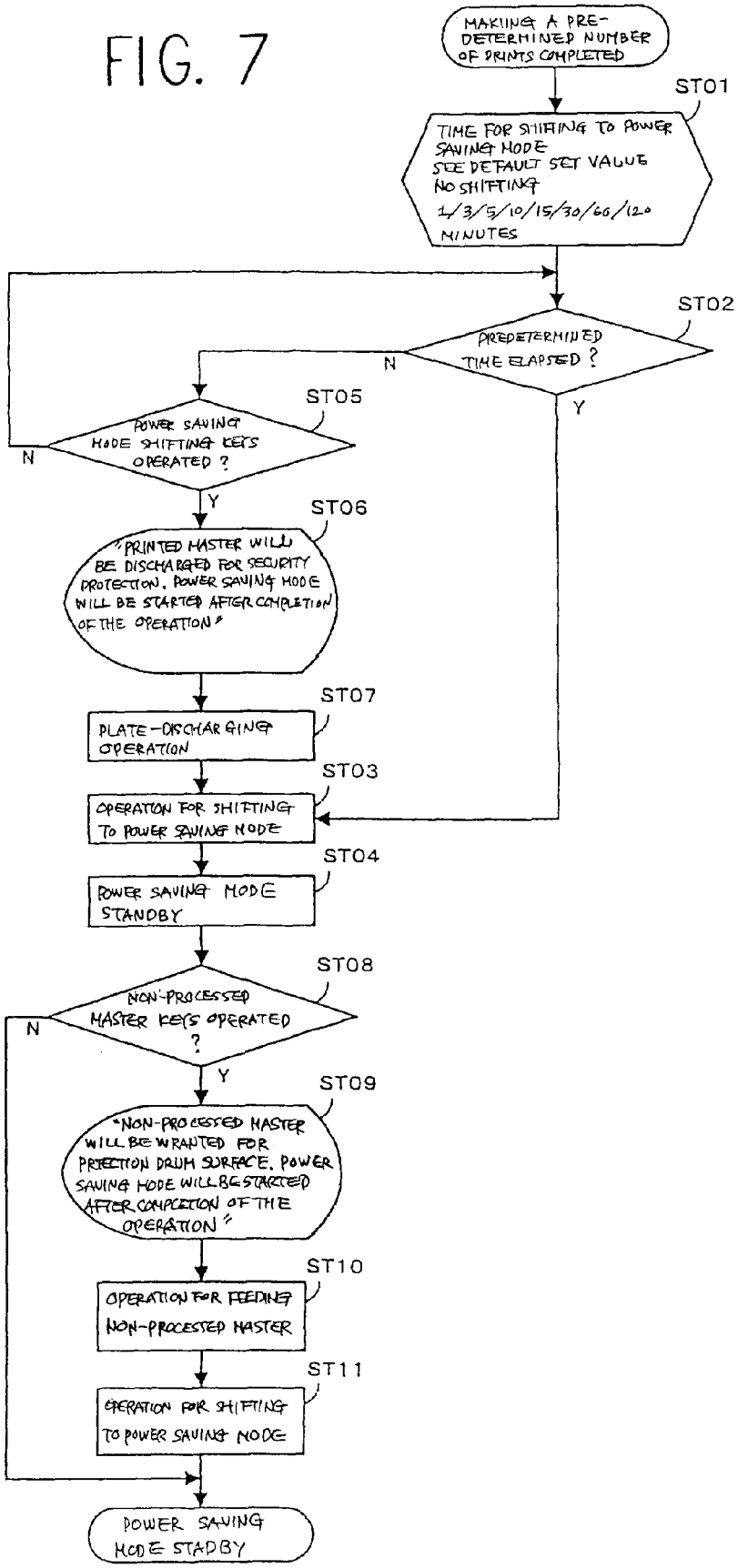
FIG. 7 is a flowchart for explaining the operations of the stencil printing apparatus according to a first example of the embodiment.

Hereinafter, the operation of the stencil printing apparatus 1, which is performed when "60 minutes" is selected in "power saving setting" and "manual" is selected in "master release standby setting," is described as a first example, on the basis of the flowchart shown in FIG. 7. Note that the flowchart shown in FIG. 6 describes the operation of the stencil printing apparatus 1 that is performed when "no operation" is selected in "master release standby setting."

Upon completion of the operation for printing the set number of prints, when "60 minutes" is selected in "power saving setting" (ST01) but the next operation instruction is not output, the timer 79 starts measuring the time (ST02), and when the measured time reaches the set 60 minutes the stencil printing apparatus 1 is shifted to the power saving mode (ST03) and enters the standby state of the power saving mode (ST04).

Figure 8:
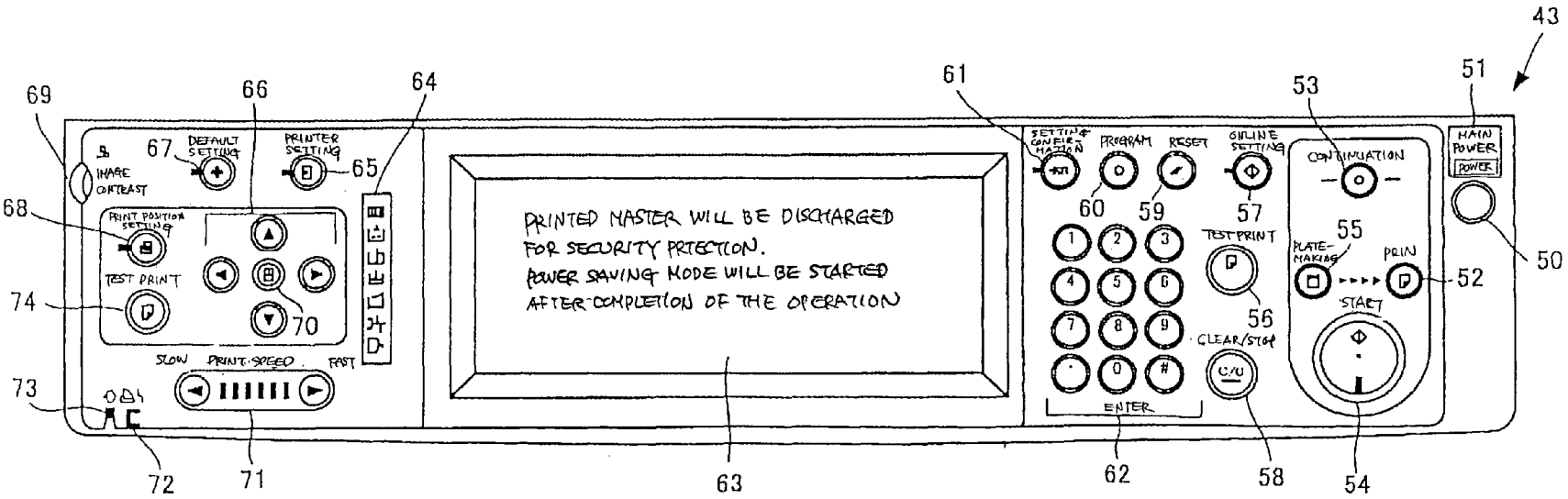
FIG. 8 and FIG. 9 are diagrams for explaining matters displayed on the operation panel.

When the operator outputs a plate discharge command before the time measured by the timer 79 reaches 60 minutes (long pressing of the power key 50, which is the same operation as the operation of "forcible shifting of power saving mode" in the present embodiment) (ST05), the display on the liquid crystal-touch panel 63 changes as shown in FIG. 8 (ST06) and the plate-discharging operation is performed (ST07). Upon completion of the plate-discharging operation, the stencil printing apparatus 1 is shifted to the power saving mode without having the master 23 wrapped around the outer circumferential surface of the plate cylinder 9 (ST03), and the display on the liquid crystal touch panel 63 is deleted, whereby the stencil printing apparatus 1 enters the standby state of the power saving mode (ST04).

A master presence/absence detection sensor, which is not shown but disposed in the vicinity of the outer circumferential surface of the plate cylinder 9, detects the presence or absence of the master 23 on the outer circumferential surface of the plate cylinder 9. While the unshown master presence/absence detection sensor detects that the master 23 is not wrapped around the outer circumferential surface of the plate cylinder 9, removal of the plate cylinder 9 from the apparatus main body 8 is prohibited.

Figure 9:
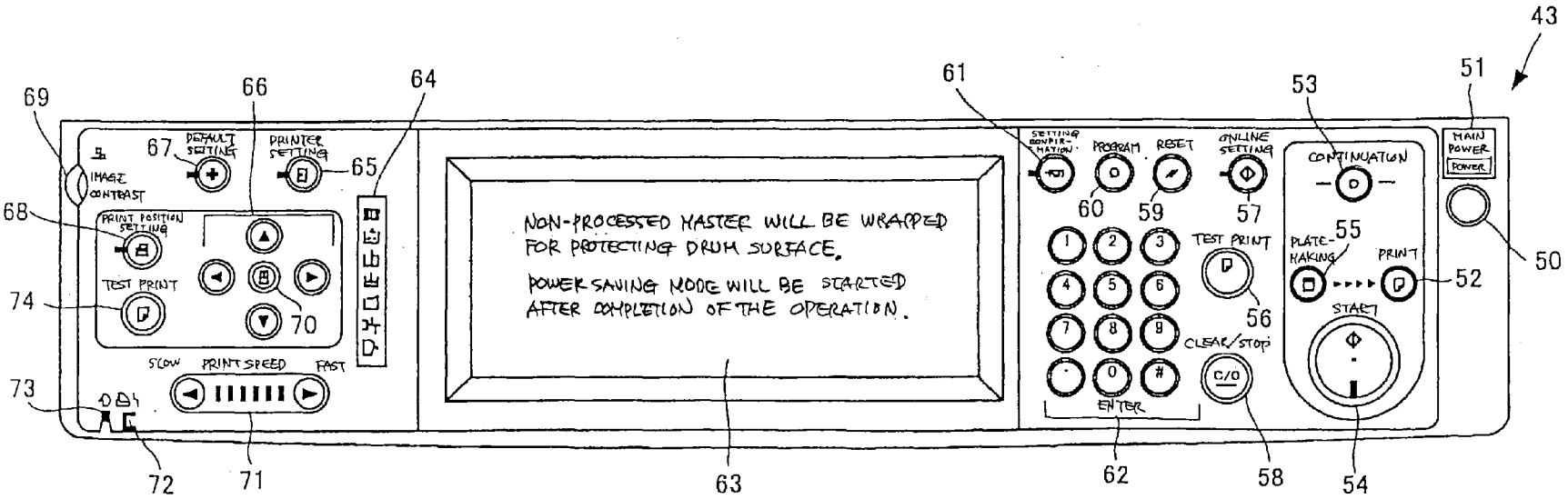

When a state where the next operation instruction is not output continues, the power saving mode standby state is continued, and when the operator outputs a plate feed command (simultaneous pressing of a dot key and the start key 54 on the numeric keypad 62; which is referred to as "non-plate-making key operation" in the flow chart) (ST08), the display on the liquid crystal touch panel 63 changes as shown in FIG. 9 (ST09) and a new unprocessed (non-processed; unperforated) master that is pulled out of the master roll 23*a* is wrapped around the outer circumferential surface of the plate cylinder 9 (ST10). Upon completion of the plate-feeding operation, the stencil printing apparatus 1 is shifted to the power saving mode in a state where the non-processed master 23 is wrapped around the outer circumferential surface of the plate cylinder 9 (ST11) and the display on the liquid crystal touch panel 63 is deleted, whereby the stencil printing apparatus 1 enters the standby state of the power saving mode.

According to the configuration described above, the stencil printing apparatus 1 is caused to enter the standby state until the next operation instruction is issued in a state where the master 23 is not wrapped around the outer circumferential surface of the plate cylinder 9 after the master 23 of a preceding plate is discharged. Therefore, the occurrence of the afterimage phenomenon can be effectively inhibited while preventing the cost increase caused by adding parts and wrapping a new unprocessed master.

Moreover, when the stencil printing apparatus 1 is in the standby state without having the master 23 wrapped around the outer circumferential surface of the plate cylinder 9, the new unprocessed master is wrapped to protect the surface of the plate cylinder 9 and the stencil apparatus 1 is kept in the standby state until the next operation instruction is issued. Therefore, the cost increase caused by adding parts can be inhibited, and prevention of the afterimage phenomenon and protection of the surface of the plate cylinder can be achieved efficiently without significantly increasing the cost of spending the least necessary unprocessed master.

Figure 10:
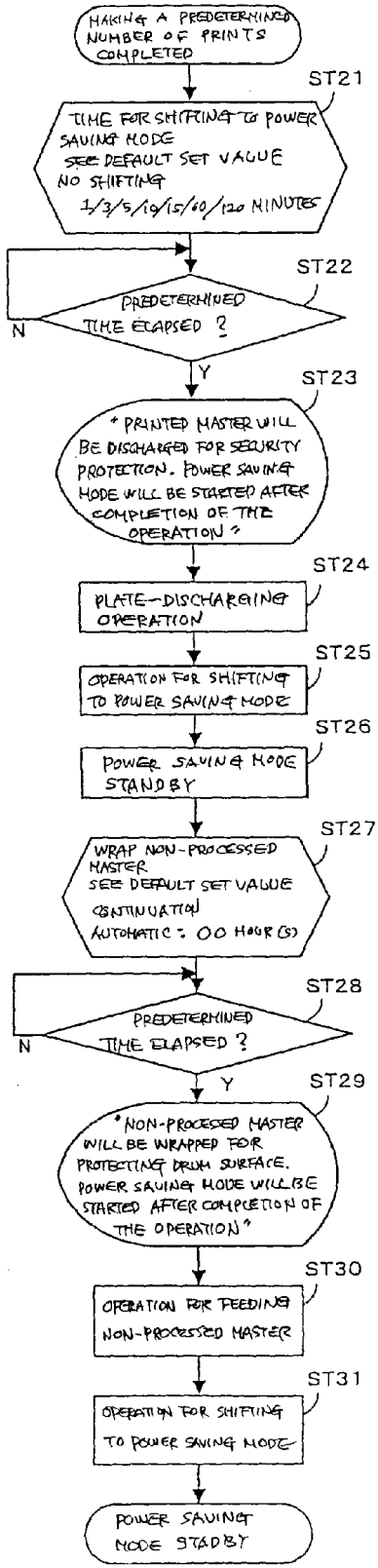
FIG. 10 is flowchart for explaining the operations performed by the stencil printing apparatus in a second example of the embodiment.

Next, the operation of the stencil printing apparatus 1, which is performed when "60 minutes" is selected in "power saving setting" and "full automatic" is selected in "master release standby setting," is described as a second example, on the basis of the flowchart shown in FIG. 10. Note that this "full automatic" allows automatic output of the plate discharge command and plate feed command. The plate discharge command is output when the time that is set in "power saving setting" elapses, and the plate feed command is output when the time that is set in "non-processed master wrapping setting" described hereinafter elapses.

Figure 11:
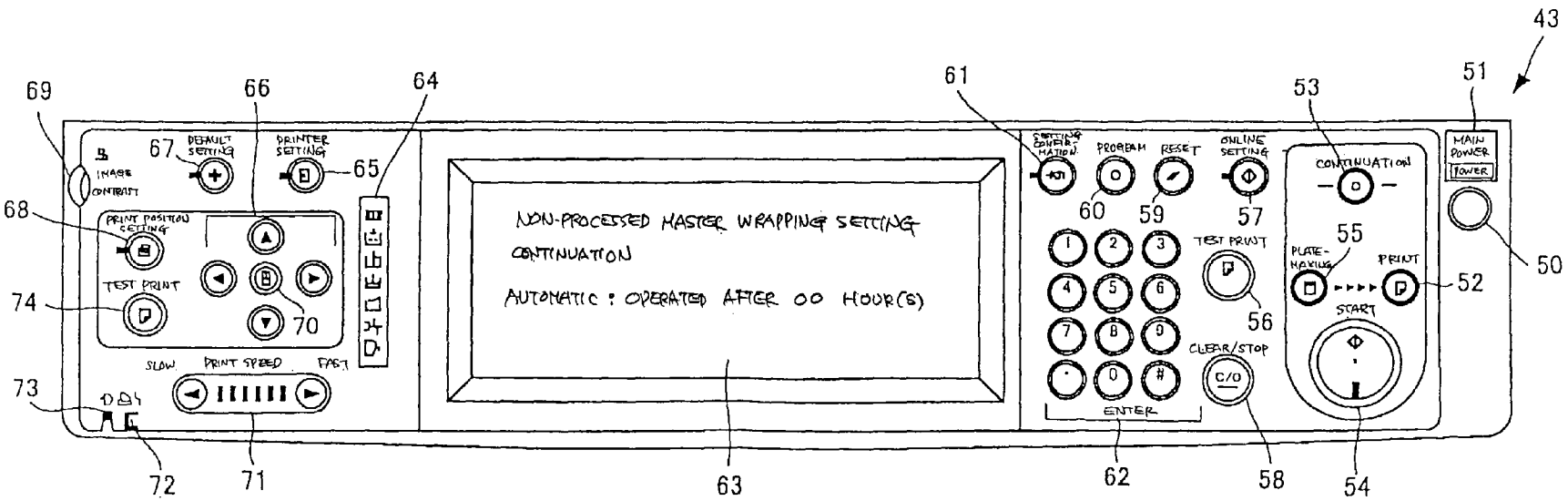
FIG. 11 is a diagram showing a schematic configuration of the operation panel to explain the non-processed master wrapping setting according to the embodiment.

When the operator presses the default setting key 67 on the operation panel 43 a predetermined number of times, the screen on the liquid crystal touch panel 63 displays "non-processed master wrapping setting" as shown in FIG. 11 is displayed, where a time can be set on a 1-hour basis. The present example explains the case where "9 hours" is set in "non-processed master wrapping setting." In the second example where "full automatic" is set, an excessive number of plate discharges and the occurrence of the afterimage phenomenon are prevented in "power saving setting" where the time required for the master 23 to be discharged from the outer circumferential surface of the plate cylinder 9 is set. Therefore, the set time is preferably not too short but at least approximately 60 minutes. Furthermore, wrapping of an unprocessed master is not performed more than necessary in "non-processed master wrapping setting" where the time required for the unprocessed master to be fed to the plate cylinder 9 is set, the plate cylinder 9 having no master wrapped therearound. Therefore, the set time is preferably approximately 9 hours, which is the time required for complete a day's work.

Upon completion of the operation for printing the set number of prints, when "60 minutes" is selected in "power saving setting" (ST21) but the next operation instruction is not output, the timer 79 starts measuring the time (ST22), and when the measured time reaches the set 60 minutes the display on the liquid crystal touch panel 63 changes as shown FIG. 8 (ST23) so that the plate-discharging operation is performed (ST24). Upon completion of the plate-discharging operation, the stencil printing apparatus 1 is shifted to the power saving mode (ST25) without having the master 23 wrapped around the outer circumferential surface of the plate cylinder 9, and the display on the liquid crystal touch panel 63 is deleted, whereby the stencil printing apparatus 1 enters the standby state of the power saving mode (ST26). Removal of the plate cylinder 9 from the apparatus main body 8 in this state is prohibited.

Thereafter, when "9 hours" is set in "non-processed master wrapping setting" (ST27) but the next operation instruction is not output, the timer 79 starts measuring the time (ST28), and when the measured time reaches the set 9 hours the display on the liquid crystal touch panel 63 changes as shown FIG. 9 (ST29), and a new unprocessed master pulled out of the master roll 23*a* is wrapped around the outer circumferential surface of the plate cylinder 9 (ST30). Upon completion of the plate-feeding operation, the stencil printing apparatus 1 is shifted to the power saving mode in a state where the unprocessed master 23 is wrapped around the outer circumferential surface of the plate cylinder 9 (ST31), and the display on the liquid crystal touch panel 63 is deleted, whereby the stencil printing apparatus 1 enters the standby state of the power saving mode. In this second example as well, the operation effects similar to those of the first example can be obtained, and the operating efficiency can be improved more than in the first example because the plate-discharging operation and plate-feeding operation are performed automatically.

Figure 12:
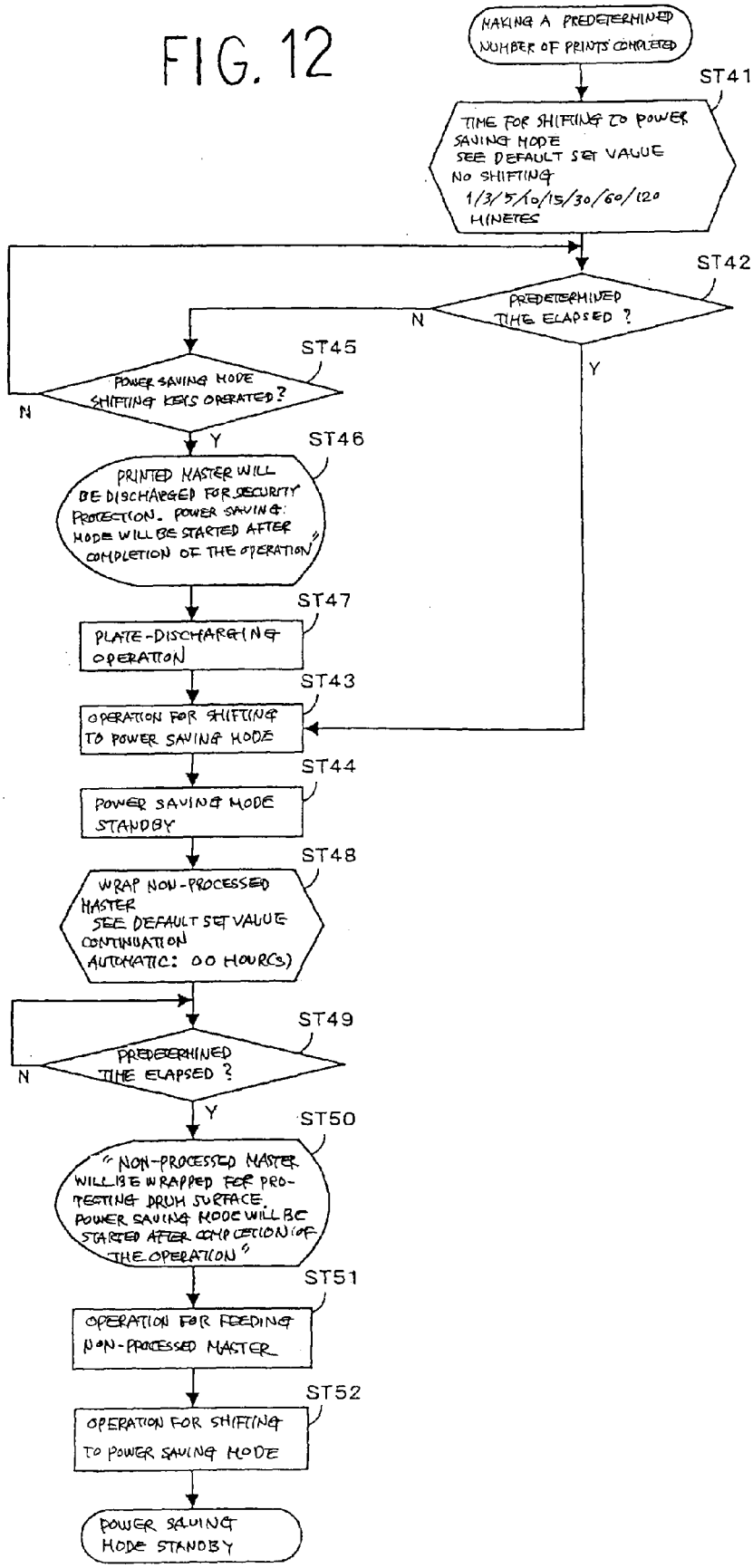
FIG. 12 is a flowchart for explaining the operations performed by the stencil printing apparatus in a third example of the embodiment.

Next, the operation of the stencil printing apparatus 1, which is performed when "60 minutes" is set in "power saving setting," "semi-automatic 1 (manual plate discharge+automatic plate feeding)" is selected in "master release standby setting" and "9 hours" is set in "non-processed master wrapping setting," is described as a third example, on the basis of the flowchart shown in FIG. 12. Note that only the plate feed-command is automatically output in this "semi-automatic 1 (manual plate discharge+automatic plate feeding)."

Upon completion of the operation for printing the set number of prints, when "60 minutes" is selected in "power saving setting" (ST41) but the next operation instruction is not output, the timer 79 starts measuring the time (ST42), and when the measured time reaches the set 60 minutes the stencil printing apparatus 1 is shifted to the power saving mode (ST43) and enters the standby state of the power saving mode (ST44).

When the operator outputs the plate discharge command as in the first example before the time measured by the timer 79 reaches 60 minutes (ST45), the display on the liquid crystal touch panel 63 changes as shown in FIG. 8 (ST46), whereby the plate-discharging operation is performed (ST47). Upon completion of the plate-discharging operation, the stencil printing apparatus 1 is shifted to the power saving mode without having the master 23 wrapped around the outer circumferential surface of the plate cylinder 9 (ST43), and the display on the liquid crystal touch panel 63 is deleted, whereby the stencil printing apparatus 1 enters the standby state of the power saving mode (ST44). Removal of the plate cylinder 9 from the apparatus main body 8 in this state is prohibited.

Thereafter, when "9 hours" is set in "non-processed master wrapping setting" (ST48) but the next operation instruction is not output, the timer 79 starts measuring the time (ST49), and when the measured time reaches the set 9 hours the display on the liquid crystal touch panel 63 changes as shown FIG. 9 (ST50), and a new unprocessed master pulled out of the master roll 23*a* is wrapped around the outer circumferential surface of the plate cylinder 9 (ST51). Upon completion of the plate-feeding operation, the stencil printing apparatus 1 is shifted to the power saving mode in a state where the unprocessed master 23 is wrapped around the outer circumferential surface of the plate cylinder 9 (ST52), and the display on the liquid crystal touch panel 63 is deleted, whereby the stencil printing apparatus 1 enters the standby state of the power saving mode. In this third example as well, the operation effects similar to those of the first example can be obtained, and the operating efficiency can be improved more than in the first example because the plate-discharging operation is performed automatically.

Figure 13:
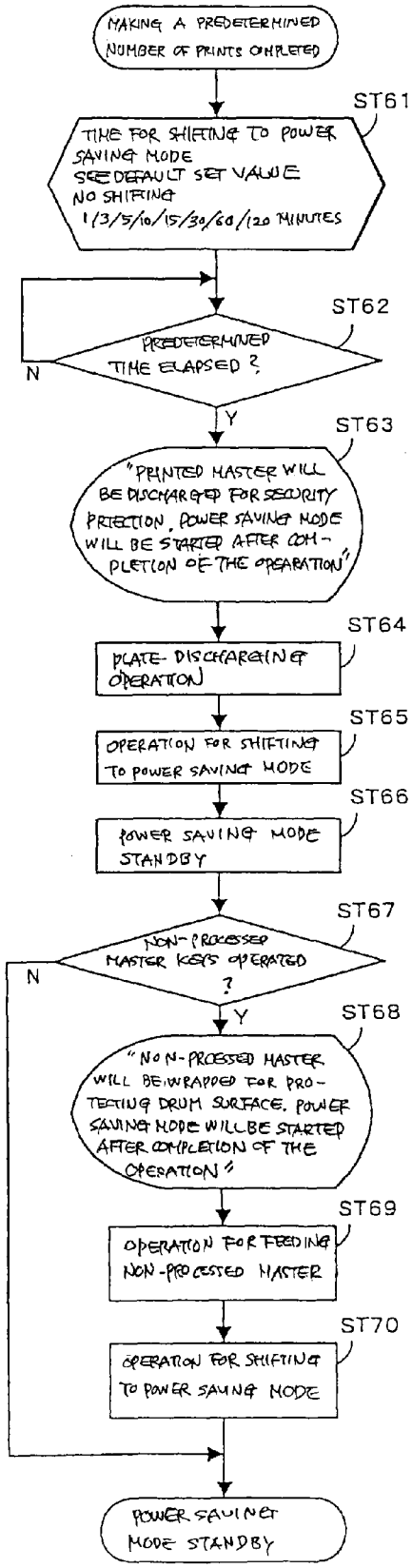
FIG. 13 is a flowchart for explaining the operations performed by the stencil printing apparatus in a fourth example of the embodiment.

Next, the operation of the stencil printing apparatus 1, which is performed when "60 minutes" is set in "power saving setting" and "semi-automatic 2 (automatic plate discharge+manual plate feeding)" is selected in "master release standby setting," is described as a fourth example, on the basis of the flowchart shown in FIG. 13. Note that only the plate discharge command is automatically output in this "semi-automatic 2 (automatic plate discharge +manual plate feeding)."

Upon completion of the operation for printing the set number of prints, when "60 minutes" is selected in "power saving setting" (ST61) but the next operation instruction is not output, the timer 79 starts measuring the time (ST62), and when the measured time reaches the set 60 minutes the display on the liquid crystal touch panel 63 changes as shown in FIG. 8 (ST63), whereby the plate-discharging operation is performed (ST64). Upon completion of the plate-discharging operation, the stencil printing apparatus 1 is shifted to the power saving mode without having the master 23 wrapped around the outer circumferential surface of the plate cylinder 9 (ST65), and the display on the liquid crystal touch panel 63 is deleted, whereby the stencil printing apparatus 1 enters the standby state of the power saving mode (ST66). Removal of the plate cylinder 9 from the apparatus main body 8 in this state is prohibited.

When a state where the next operation instruction is not output continues, the power saving mode standby state is continued, and when the operator outputs the plate feed command as in the first example (ST67), the display on the liquid crystal touch panel 63 changes as shown in FIG. 9 (ST68) and a new unprocessed master that is pulled out of the master roll 23*a* is wrapped around the outer circumferential surface of the plate cylinder 9 (ST69). Upon completion of the plate-feeding operation, the stencil printing apparatus 1 is shifted to the power saving mode in a state where the unprocessed master 23 is wrapped around the outer circumferential surface of the plate cylinder 9 (ST70) and the display on the liquid crystal touch panel 63 is deleted, whereby the stencil printing apparatus 1 enters the standby state of the power saving mode. In this fourth example as well, the operation effects similar to those of the first example can be obtained, and the operating efficiency can be improved more than in the first example because the plate-feeding operation is performed automatically.

As described above, in the stencil printing apparatus 1, "no operation," "manual," "full automatic," "semi-automatic 1 (manual plate discharge+automatic plate discharge)" or "semi-automatic 2 (automatic plate discharge+manual plate feeding)" can be selected for performing the plate-discharging operation for discharging the master from the plate cylinder 9 and the plate-feeding operation for feeing a master to the plate cylinder 9. As a result, the operator can set detailed printing procedures including additional printing without having the apparatus control operation interrupt the printing jobs, and prevention of the afterimage phenomenon and protection of the surface of the plate cylinder can be achieved efficiently by performing the operations instructed by the operator.

Also, the settings can be changed in any ways in "power saving setting" and "master release standby setting" so that the operator can set the detailed printing procedures without having the apparatus control operation interrupt the printing jobs. For example, a free operator can select "full automatic" for causing the apparatus to perform the operations completely accurately, while a full-time operator can select "manual," and they both can reset the time for activating the plate discharge command and plate feed command in accordance with the usage. Therefore, prevention of the afterimage phenomenon and protection of the surface of the plate cylinder can be achieved efficiently.

By allowing the operator to perform a manual operation by performing designated key operations on the operation panel 43, the operator can confirm the operation securely and thereby leave the apparatus at ease after discharging the plate for preventing an afterimage and after feeding a plate for protecting the surface of the plate cylinder upon completion of a printing job.

Moreover, by performing the automatic operation in conjunction with the power saving mode, the apparatus can be operated automatically even when the operator accidentally forgets to issue an operation command or when the free operator might not be able to use the apparatus appropriately. Therefore, prevention of the afterimage phenomenon and protection of the surface of the plate cylinder can be achieved securely without excessively wrapping an unprocessed master or leaving the surface of the plate cylinder exposed for a long time.

In addition, because removal of the plate cylinder 9 from the apparatus main body 8 while the master 23 is wrapped around the outer circumferential surface of the plate cylinder is prohibited, adhesion of foreign matters to the surface of the plate cylinder 9, contamination of the hands and cloth of the operator, and clogging caused by excessively dried ink can be prevented, and prevention of the afterimage phenomenon and protection of the surface of the plate cylinder can be achieved securely.

According to the present invention, the stencil printing apparatus is kept in the standby state until the next operation instruction is issued in a state where the plate cylinder discharges a master of a preceding plate and does not have a master wrapped around its outer circumferential surface. Therefore, the cost increase caused by adding parts can be inhibited, and prevention of the afterimage phenomenon can be achieved efficiently without increasing the cost of wrapping a new unprocessed master.

Moreover, when the stencil printing apparatus is in the standby state without having a master wrapped around the outer circumferential surface of the plate cylinder, the stencil printing apparatus is kept in the standby state until the next operation instruction is issued after a new unprocessed master is wrapped to protect the surface of the plate cylinder. Accordingly, the cost increase caused by adding parts can be inhibited, and prevention of the afterimage phenomenon and protection of the surface of the plate cylinder can be achieved efficiently without significantly increasing the cost of spending the least necessary unprocessed master.

Various modifications will become possible for those skilled in the art after receiving the teachings of the present disclosure, without departing from the scope thereof.

What is claimed is:

1. A stencil printing apparatus for wrapping a master around an outer circumferential surface of a plate cylinder to perform printing, the stencil printing apparatus comprising:

means for measuring a leaving time during which the apparatus is left idle, the leaving time being a total time since completion of an operation for printing; and means for controlling a plate-discharging portion, the means for controlling outputs a plate-discharge command to the plate-discharging portion before the means for measuring measures the leaving time as exceeding a first predetermined time while the master is wrapped around the outer circumferential surface, and the means for controlling shifts the stencil printing apparatus to a standby state after the master is discharged from the outer circumferential surface so that the outer circumferential surface is unwrapped in the standby state, the standby state being a state during which the means for measuring continues to measure the leaving time.

2. The stencil printing apparatus as claimed in claim 1, wherein the means for controlling further controls a plate-making portion and outputs a plate-feed command to the plate-making portion while the outer circumferential surface is unwrapped, and the means for controlling shifts the stencil printing apparatus to the standby state after an unprocessed master is wrapped around the outer circumferential surface.

3. The stencil printing apparatus as claimed in claim 2, wherein the means for controlling outputs the plate-discharge command automatically or based on a manually entered command and the plate-feed command automatically or based on a manually entered command.

4. The stencil printing apparatus as claimed in claim 3, wherein the means for controlling automatically outputs the plate-discharge command after the means for measuring measures the leaving time as exceeding the first predetermined time.

5. The stencil printing apparatus as claimed in claim 4, wherein the means for measuring measures the first predetermined time and a second predetermined time, and at least one of the predetermined times is set.

6. The stencil printing apparatus as claimed in claim 5, wherein the means for controlling automatically outputs the plate-feed command after the means for measuring measures the leaving time as exceeding the second predetermined time and upon completion of a plate-discharging operation.

7. The stencil printing apparatus as claimed in claim 2, wherein the means for controlling outputs neither the plate-discharge command nor the plate-feed command.

8. The stencil printing apparatus as claimed in claim 2, further comprising:

a master stock means and a fan drawing in the master to assist in plate-making the master on the outer circumferential surface.

9. The stencil printing apparatus as claimed in claim 3, further comprising:

an operation panel having a variety of keys, wherein the means for controlling outputs the plate-discharge command and the plate-feed command based on manually entered commands, the manually entered commands being entered by operating the keys.

10. The stencil printing apparatus as claimed in claim 1, wherein the means for controlling further shifts the stencil printing apparatus to a power saving mode for reducing power consumption of the apparatus, and the means for controlling automatically shifts the stencil printing apparatus to the power saving mode during the standby state.

11. The stencil printing apparatus as claimed in claim 1, wherein the plate cylinder is a detachable plate cylinder that is removable from an apparatus main body, the detachable plate cylinder prohibited from being removed from the apparatus main body when the outer circumferential surface is unwrapped.

12. The stencil printing apparatus as claimed in claim 1, further comprising:

a release pawl and a release fan to assist in plate-discharging the master from the outer circumferential surface.

13. A stencil printing apparatus for wrapping a master around an outer circumferential surface of a plate cylinder to perform printing, the stencil printing apparatus comprising:

a timer measuring a leaving time during which the apparatus is left idle, the leaving time being a total time since completion of an operation for printing; and a CPU controlling a plate-discharging portion, the CPU configured to output a plate-discharge command to the plate-discharging portion before the timer measures the leaving time as exceeding a first predetermined time while the master is wrapped around the outer circumferential surface, and the CPU configured to shift the stencil printing apparatus to a standby state after the master is discharged from the outer circumferential surface so that the outer circumferential surface is unwrapped in the standby state, the standby state being a state during which the timer continues to measure the leaving time.

* * * * *